United States Patent [19]

Senter

[11] 4,026,044

[45] May 31, 1977

[54] ARTICLE OF FOOTWEAR AND METHOD OF MAKING SAME

[75] Inventor: Jonas Senter, Greenwich, Conn.

[73] Assignee: CITC Industries, Inc., New York, N.Y.

[22] Filed: Aug. 13, 1976

[21] Appl. No.: 714,263

Related U.S. Application Data

[63] Continuation of Ser. No. 473,317, May 24, 1974, abandoned.

[52] U.S. Cl. ..... 36/14; 36/25 R; 36/32 R; 128/586

[51] Int. Cl.[2] ..... A43C 13/08

[58] Field of Search ..... 36/14, 28, 32 R, 43, 36/44; 12/142 E; 128/586, 607

[56] References Cited

UNITED STATES PATENTS

| | | | |
|---|---|---|---|
| 1,636,905 | 7/1927 | Falor et al. | 36/14 X |
| 1,699,472 | 1/1929 | Lundy | 36/14 X |
| 1,720,120 | 7/1929 | Diveley et al. | 36/14 X |
| 1,753,872 | 4/1930 | Steed | 36/14 |
| 1,839,984 | 1/1932 | McGhee | 36/14 |
| 2,527,414 | 10/1950 | Hallgren | 36/32 R |
| 2,528,357 | 10/1950 | Glassman | 36/14 X |
| 3,087,261 | 4/1963 | Russell | 36/28 |
| 3,145,487 | 8/1964 | Cronin | 36/14 X |

FOREIGN PATENTS OR APPLICATIONS

| | | | |
|---|---|---|---|
| 244,800 | 1/1927 | United Kingdom | 36/14 |

*Primary Examiner*—Alfred R. Guest

[57] ABSTRACT

An article of footwear wherein a rubber-like shoe base portion is joined to a shoe upper and vulcanized in conjunction therewith so as to form an integrally bonded construction while concurrently being molded so as to define at least the bottom surface pattern of the shoe sole, and with a foxing and, if required, a toe bumper portion adapted to be subsequently manually fastened to the circumference of the shoe sole in accordance with the desired aesthetic characteristics of the sport shoe.

1 Claim, 3 Drawing Figures

ARTICLE OF FOOTWEAR AND METHOD OF MAKING SAME

This is a continuation of application Ser. No. 473,317, filed May 24, 1974, now abandoned.

FIELD OF THE INVENTION

The present invention pertains to footwear, or more particularly to footwear of the type forming a sport shoe construction and, moreover, relates to a method of forming the footwear.

Footwear of the above-mentioned type, which may consist of sport shoes, tennis shoes and the like, generally consists of a shoe upper or lasting which is fastened to a shoe sole of a rubber-like material so as to provide flexibility for the latter. In order to impart a decorative aesthetic appearance to the sport shoe, a foxing, which may have decorative colors and/or indicia formed thereon, is fastened about the circumference of the shoe sole, and further may have a toe bumper portion attached thereto.

DISCUSSION OF THE PRIOR ART

Heretofore, in forming footwear or, more precisely, a sport shoe, a pre-molded rubber-like sole is normally fastened to a shoe upper or lasting by being stitched to the latter. subsequently, the foxing and toe bumper portion are attached to the shoe sole, and the entire assembly may be then vulcanized in order to form a generally bonded structure for the shoe.

The foregoing method of manufacturing the footwear or sport shoe is, however, subject to a number of significant limitations and disadvantages. Thus, quite frequently, the foxing, and possibly the toe bumper portion, is of rubber or a rubber-like material having physical properties and colors which differ from the material used in the construction of the shoe sole. Consequently, during vulcanization of the entire assembly there is a tendency of the colors to run and merge, thereby obscuring the delineation between the foxing and the edges of the bottom of the shoe sole and, from a commercial standpoint, rendering the shoe less attractive.

Another limitation encountered in the prior art structure requires an initial fastening between the lasting and shoe sole, and a precedent molding of the shoe sole, thus necessitating additional manufacturing steps. Furthermore, the vulcanizing of the foxing and toe bumper portion to the shoe sole limits the variations in physical appearance which may be imparted to the sport shoe.

It is also common in the prior art to mold the shoe sole, foxing and toe bumper portion in a unitary element. This frequently causes mold marks and ridges to be present on the outer surface of the foxing. In effect, the shoe will look like a mass-produced, machine-made article making it less saleable than a so-called "handmade" or finished article of footwear.

SUMMARY OF THE INVENTION

Accordingly, it is an object of the present invention to provide a novel footwear, such as sport shoes amd the like of the above-mentioned type, resulting in a superior construction and aesthetic appearance. Another object of the present invention is to provide a footwear article evincing a superior construction and having a "handmade" aesthetic appearance in comparison with the footwear which is representative of the state of the art.

A still further object of the present invention is to provide footwear or a sport shoe of the type described which, in comparison with prior-art footwear, is much more durable in wear, possesses a superior degree of flexibility, and is much less expensive to manufacture.

In essence, the present invention contemplates footwear wherein a rubber-like shoe base portion is joined to a shoe upper and vulcanized in conjunction therewith so as to form an integrally bonded construction while concurrently being molded so as to define at least the bottom surface pattern of the shoe sole, and with the foxing and toe bumper portion adapted to be subsequently manually fastened to the circumference of the shoe sole in accordance with the desired aesthetic characteristics of the sport shoe.

BRIEF DESCRIPTION OF THE DRAWINGS

Referency may now be had to the following detailed description of an exemplary embodiment of the invention, taken in conjunction with the accompanying drawing, in which.

DETAILED DESCRIPTION

Figure 1:
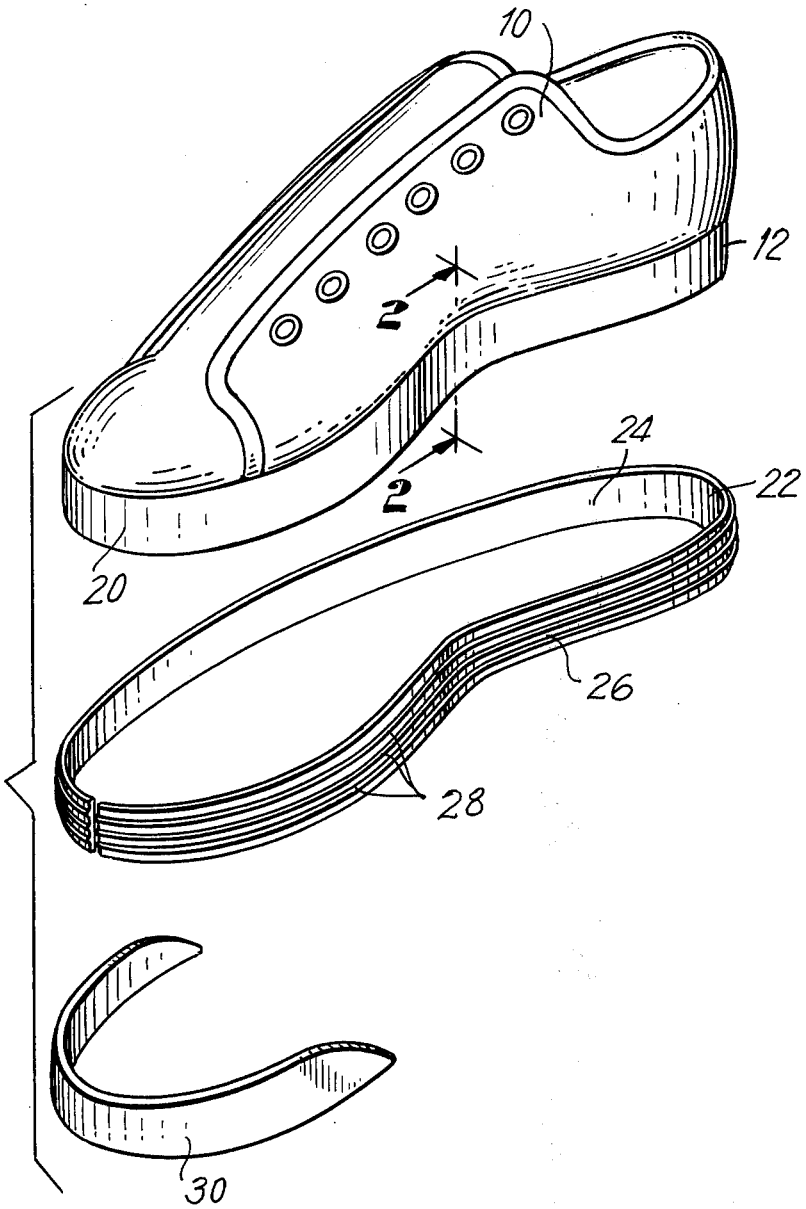
FIG. 1 is an exploded perspective view showing the method of constructing a sport shoe in accordance with the present invention.

Referring now in detail to the drawings, in which FIG. 1 illustrates an exploded perspective view of footwear or sport shoe construction formed in accordance with the inventive method, the sport shoe includes an upper 10 which is integrally bonded to a sole portion 12. The upper 10 may be formed of canvas, or any other suitable material, generally employed in the construction of sport shoes of the so-called "sneaker" type. The sole portion 12 may be formed of either a natural rubber, a rubber-like synthetic material, or plastic material which is also commonly used for the sole of that type of sport shoe.

In the forming of the shoe, the inventive method includes the step of positioning the upper 10 so that an inner end or rim portion 14 thereof is located along and in contact with the upper surface 16 of the sole portion 12. Subsequently, by utilizing a suitable vulcanizing apparatus or autoclave (not shown), the upper 10 may be vulcanized to the sole portion 12 so as to form an integrally bonded structure therewith. Concurrently, the bottom portion or surface 18 of sole portion 12 may be shaped so as to provide the finished sport shoe sole pattern or configuration. The annular or peripheral side wall 20 of the sole portion 12 may remain in a substantially semi-finished or unfinished condition during the molding or vulcanizing sequence.

Subsequently, a predetermined length of foxing 22 may be cut off, either manually or mechanically, from a continuous web or roll of foxing tape and positioned along the side surface 20 of sole portion 12 so that the inner surface 24 of the foxing 22 contacts the full peripheral length of the sole portion 12. A suitable adhesive material may be interpositioned between the sole side wall surface 20 and the surface 22 on the foxing so as to form a permanent adhesive bond between the foxing 22 and the sport shoe sole portion 12.

As illustrated, if desired, the external surface 26 of the foxing 22 may be provided with a series of decorative parallel ribs 28. However, it becomes readily apparent that other decorative indicia, colorings, and surface contouring may be applied to the foxing surface 26 so as to impart a varied aesthetic appearance to the sport shoe.

Figure 3:
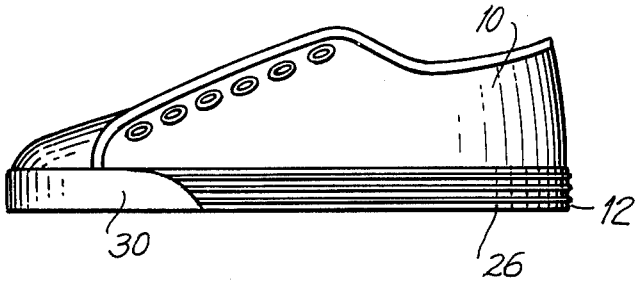
FIG. 3 is a side view of the assembled sport shoe of FIG. 1, constructed in accordance with the inventive method.

Additionally, as shown in FIG. 3, a reinforcing, and if desired decorative, toe bumper portion 30 may be fastened to the foxing so as to extend along the front or toe end of the shoe. The bumper portion 30 will provide a toe-protective reinforcement for the sport shoe which will increase the life of the shoe, while concurrently still further enhancing its aesthetic appearance. Suitable coloring, decorative indicia or surface contouring may also be provided on the toe bumper portion 30. The toe bumper portion 30 may be formed of any suitable rubber, rubber-like or plastic material, similar to that employed in forming the foxing 22.

Figure 2:
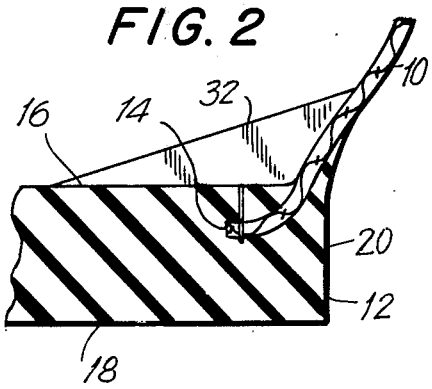
FIG. 2 is a fragmentary sectional view on the inner or arch side of the shoe taken along line 2–2 transversally in FIG. 1.

Internally of the upper 10, in its inner area where the wearer's arch will be located, lasting 10, as shown in FIG. 2, and unitarily molded with the upper surface 16 of the sole portion 12, may be a plurality of parallel spaced ribs 32 which form an instep-supporting portion for an inner sole (not shown) which is adapted to be inserted into the sport shoe. It can readily be recognized from the upper portion of FIG. 1 and from FIG. 2 that the ribs 32 run substantially transversally to the longitudinal axis of the sport shoe, namely in the drawing plane of FIG. 2. At least one such rib is provided.

As may be readily ascertained from the foregoing description, the integrally bonded structure uniting the upper 10 and the sole portion 12 will provide for a superior and highly durable wear-resistant shoe construction. If required, suitable connecting stitching may also be provided between the lasting 10 and the sole portion 12 so as to enhance the degree or firmness of attachment therebetween.

Since the foxing 22 may, at times, be formed of a material incorporating colors which differ with respect to the material and colors employed for the sole portion 12, the inventive method, which eliminates vulcanization between the foxing and the toe bumper portion 30, avoids the possible running-over and smudging of the colors between the bottom of the sole portion and the foxing, which is frequently caused by heat during vulcanization. Consequently, the present shoe provides for a highly pleasing aesthetic appearance, showing a sharp color delineation between the sole bottom and the foxing, which is indicative of the shoe being a "handmade" article rather than the usual type of machine-made shoe. This, of course, will considerably enhance the commercial value and saleability of the shoe, while concurrently providing a shoe which is possessed of much more rugged, flexible and durable construction.

Needless to say, numerous and varied types of materials, color combinations and shoe arrangements may be created in employing the described method of forming the footwear. Thus, for example, the shoe may be constructed without a toe bumper portion 30, or the upper 10 may be constituted of a material or materials other than canvas.

While there has been shown what is considered to be the preferred embodiment of the invention, it will be obvious that modifications may be made which come within the scope of the disclosure of the specification.

What is claimed is:

1. An article of footwear comprising, in combination, an upper (10); a single-piece rubber-like outer shoe-sole portion (12) having a tread on the bottom surface (18) thereof; said upper having a lower end portion (14) thereof embedded in said sole portion and being vulcanized thereto so as to form an integrally bonded unitary structure; a foxing (22) encompassing a circumferential side wall (20) of said sole portion; a toe bumper portion (30) fastened to said foxing along at least the toe portion, with said foxing and said toe bumper portion cemented to said sole portion; and a plurality of parallel spaced longitudinal arch-supporting ribs (32) internally of said upper, on its inner side where the wearer's arch is located, substantially transversal to the longitudinal axis of the footwear, integrally formed with an upper surface (16) of said sole portion and adapted to be covered by an inner sole.

* * * * *